United States Patent [19]

Blewitt et al.

[11] Patent Number: 4,528,536

[45] Date of Patent: Jul. 9, 1985

[54] HIGH VOLTAGE FUSE WITH CONTROLLED ARC VOLTAGE

[75] Inventors: Donald D. Blewitt, Penn Hills; Theodore Vojnovich, Murrysville, both of Pa.

[73] Assignee: Westinghouse Electric Corp., Pittsburgh, Pa.

[21] Appl. No.: 569,053

[22] Filed: Jan. 9, 1984

[51] Int. Cl.[3] ..... H01H 85/00

[52] U.S. Cl. ..... 337/5; 337/4; 337/158; 337/293

[58] Field of Search ..... 337/4, 5, 158, 293, 337/161, 162, 229, 273; 338/215; 361/2, 104

[56] References Cited

U.S. PATENT DOCUMENTS 1,889,585 11/1932 Zodrow et al. ..... 337/293
2,110,690 3/1938 Zierahn ..... 338/215

FOREIGN PATENT DOCUMENTS 10082 of 1914 United Kingdom ..... 337/293

*Primary Examiner*—Harold Broome
*Attorney, Agent, or Firm*—L. P. Johns

[57] ABSTRACT

There is provided a current limiting fuse having an electrically parallel connected non-linear resistor element for limiting and shaping the arc voltage developed during current interruption.

2 Claims, 6 Drawing Figures

HIGH VOLTAGE FUSE WITH CONTROLLED ARC VOLTAGE

CROSS-REFERENCE TO RELATED APPLICATIONS

This application is related to application Ser. No. 570,489, filed Jan. 13, 1984.

BACKGROUND OF THE INVENTION

1. Field of the Invention:

This invention relates generally to current limiting high voltage fuses and more particularly to high voltage fuses having means for shaping and controlling the arc voltage developed by the fuse during high current interruptions.

2. Description of the Prior Art:

The current limiting effect in current limiting fuses is determined primarily by the shape and magnitude of the arc voltage developed by the fuse during high current interruptions. The characteristics of the arc voltage are externally sensitive to circuit voltage, inductance, fault level and current symmetry. The controlling factors associated with the fuse include length and morphology of the element, number of parallel elements, shunting effects such as those caused by parallel indicator wires and the like, and type and grain size distribution of the sand filler.

From the interruption standpoint, the ideal arc voltage shape would be rectangular. That is, it would instantaneously rise to a fixed, predetermined level and remain there until current extinction was assured, at which time it would then drop to zero. A number of designs have been offered over the years which attempt to approach this ideal characteristic. The most successful of these was the replacement of the wire element with one consisting of a thin ribbon or strip with perforations or notches arranged along its length.

Notches are conventionally provided in the fuse element of current limiting fuses to control and limit the fuse arc voltage generated during fault current interruption. Elements of uniform cross section, such as wires, unnotched strips and the like, lack this control feature and are capable of generating arc voltages high enough to cause insulation failures in associated equipment. However, to insure adequate performance on low current clearing, or to achieve small current ratings, certain higher voltage fuses require that wire elements be employed. One problem associated with wire elements is that the arc voltage magnitude varies directly with the fault current level. More exactly, arc voltage is a function of the available fault current in the current limiting region of interest. Additionally, for similar circumstances, arc voltage is a linear function of wire element length. Because of this, a fuse design equipped with a wire element long enough to effect satisfactory low current clearing might well generate a peak arc voltage which exceeds the value permitted by standards on high current faults. In some situations, this excessive arc voltage could actually endanger the insulation of the protected system. Ironically, the high arc voltage developed in situations of this sort is not really effective in achieving high fault interruption because it typically collapses before the fault current has been sufficiently turned around.

The arc voltage peak will be somewhat reduced and extended in time duration by increasing the number of parallel elements or by incorporating an indicator wire.

The classical solution, however, consists of providing wire elements which have a varying cross section. The usual approach might be to join lengths of, say, three wires of different diameters together. The overall length would be sized to satisfy the low current clearing requirements. On high currents, the peak arc voltage would be primarily determined by the length of the smallest diameter wire, which would necessarily be the first to open. As the first peak starts to collapse, the second diameter wire opens and rebuilds the voltage peak to near the first level. The collapse and rebuild repeats with the third and final diameter. It can be seen that this technique not only limits the magnitude but also spreads out the arc voltage in an approximation of the ideal rectangular shape. The ultimate form of this approach, presently used by some fuse manufacturers, consists of a wire element with a tapering diameter.

The wire element designs just discussed have certain disadvantages. The non-uniform element is not as effective on low current interruptions as in an element of one diameter. The element is difficult and costly to fabricate. Finally, even though the element is designed to open sequentially along its length, arc voltage will still vary with the available fault current, and may therefore impose an upper limit on the interrupting rating of the fuse.

SUMMARY OF THE INVENTION

There is provided by this invention a high voltage wire element fuse design which absolutely controls and shapes the arc voltage characteristic by means of a non-linear resistor connected in parallel with the fusible element. The non-linear resistor may be any of a number of voltage limiting devices such as selenium, silicon carbide, or zinc oxide.

DESCRIPTION OF THE PREFERRED EMBODIMENT

Figure 1:
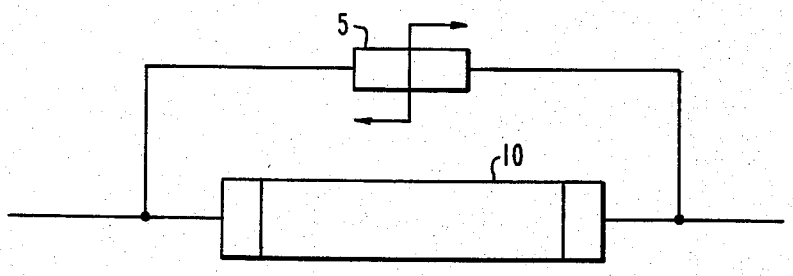
FIG. 1 is a schematical representation of a high voltage fuse utilizing a non-linear resistor element.

Referring to FIG. 1, a schematical representation of the current limiting fuse 10 having a non-linear resistor element 5 in parallel is shown. The fuse element may be a contemporary wire element with a voltage limiting device such as selenium, silicon carbide, or zinc oxide. Zinc oxide has the most satisfactory non-linear resistor characteristics based upon present technology and is, therefore, the preferred choice. Zinc oxide may be fabricated in a variety of shapes and formulations to suit the fuse application.

Figure 2A:
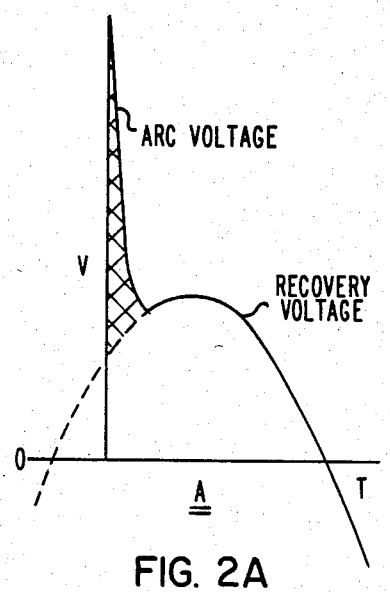
FIG. 2A is an arc voltage wave shape for a current limiting fuse without the controlled arc voltage characteristic.
Figure 2B:
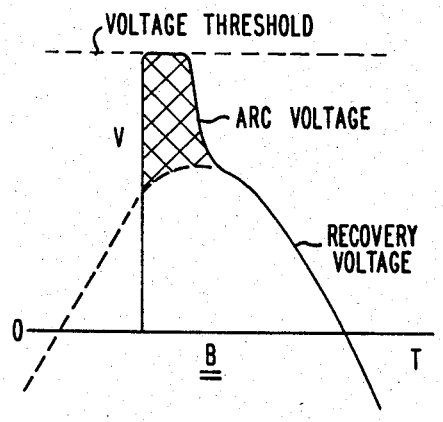
FIG. 2B is an arc voltage wave shape using a non-linear resistor element to control and shape the arc voltage.

According to the principles of this invention, FIG. 2 illustrates the operation of the current limiting fuse. The high fault arc voltage typical of a contemporary fuse is represented at FIG. 2A. The arc voltage shape expected from the same fuse with an appropriately sized non-linear resistor across it is given at FIG. 2B. It can be readily seen that one effect of the non-linear resistor is to act as a voltage clamp to limit the magnitude of the arc voltage. What is not apparent, however, is the mechanism responsible for extending the voltage out in time to approximate the ideal rectangular shape. It can be shown that the volt seconds applied to the circuit by the source during a time between fault inception and fuse melting is equal to the net volt seconds appearing across the fuse during arcing, provided that energy supplied by the source during the arcing phase is neglected. Stated another way, energy stored in the circuit during melting must be absorbed by the fuse during arcing. Neglecting source energy supplied during arcing merely establishes a minimum value for the volt seconds. The arcing volt seconds is shown by the cross-hatched areas in the Figures under the arc voltage curve. Based on the relationships given, the arcing volt-second area for FIG. 2A must necessarily be equal to the arcing volt-second area of FIG. 2B. Because of the voltage clamping effect of the non-linear resistor in FIG. 2B, the only way the areas will be equal is for the arc voltage to be extended in time as shown.

A current limiting fuse, as a circuit interrupter, is a passive device in that it supplies no external energy to effect current interruption. Interruption, at high fault levels, is achieved by using the circuit energy stored during the melting phase to generate an arc voltage which opposes and limits the fault current. For similar fuses, the stored energy available for interruption should be the same. It follows that the fuse which utilizes the fixed amount of stored energy in the most efficient manner will achieve the best interruption. On this basis, this invention should have superior interrupting ability since the stored circuit energy is used to generate an optimized arc voltage instead of one which is needlessly too high, and consequently collapses prematurely. In applying a zinc oxide non-linear resistor for use with a particular current limiting fuse design, the limiting or clamping voltage level would be adjusted to approximately twice the peak voltage rating of the fuse by controlling the length of the zinc oxide cylinder or by adjusting the chemical composition or treatment parameters of the zinc oxide compound itself. This insures that the peak arc voltage would be within limits imposed by appropriate standards, and yet is high enough such that the leakage current through the non-linear resistor element when the fuse has opened would be very small. The diameter of the non-linear resistor would depend upon the current rating of the fuse. The limiting action of the non-linear resistor arises because it temporarily shunts current when the threshold voltage is exceeded. Higher current ratings will have higher values of let-through current during interruption, and the non-linear resistor must be sized to accommodate them.

Figure 3:
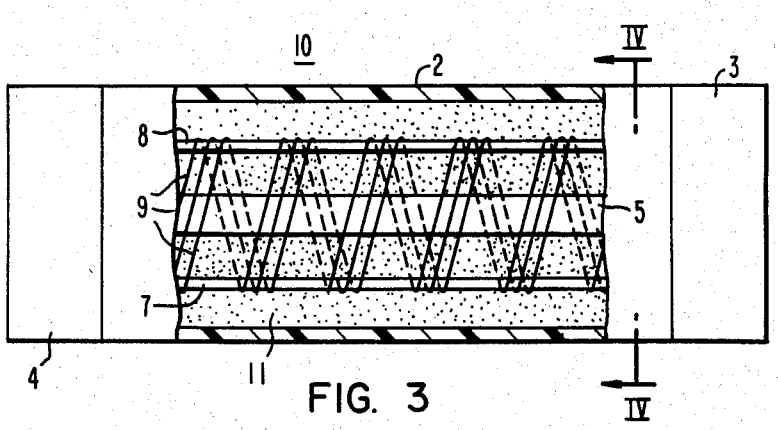
FIG. 3 is a partial cross-sectional view of a current limiting fuse incorporating the principles of this invention.
Figure 4:
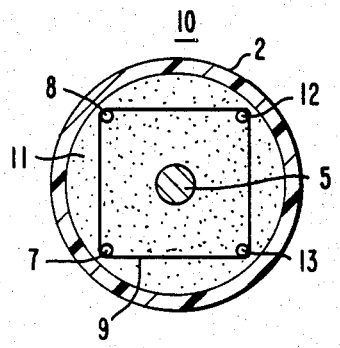
FIG. 4 is a sectional view of the current limiting fuse shown in FIG. 3 taken along the lines IV—IV of FIG. 3.

Referring to FIGS. 3 and 4, there is shown a current limiting fuse 10 incorporating the principles of this invention. The current limiting fuse 10 is generally comprised of an insulating fuse barrel 2 sealed by electrically conductive end terminals 3 and 4. A preferably zinc oxide non-linear resistor element 5 is located in the center of the fuse barrel and electrically connected to the end terminals 3 and 4. Core support rods 7, 8, 12 and 13 extend the entire length of the fuse barrel 2 and form a fuse mandrel or spider around which the wire fuse elements 9 are wound having one end of each soldered or electrically connected to each of the end terminals 3 and 4. The interior of the fuse is filled with silica quartz sand or other suitable filler 11 to aid in absorbing the heat and extinguishing arcs generated during operation of the fuse.

Figure 5:
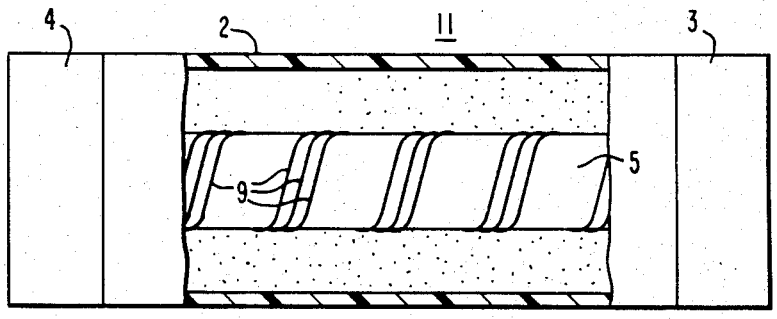
FIG. 5 is an alternate embodiment of a current limiting fuse incorporating the principles of this invention.

FIG. 5 illustrates another embodiment of a current limiting fuse incorporating the principles of this invention. In this design, the core support rods 7, 8, 12 and 13 are eliminated and fuse elements 9 are spiralled directly around the zinc oxide non-linear resistor element 5. If the fuse has no low current clearing requirements, the elements may be in direct contact with the zinc oxide resistor element. If low current clearing ability is desired, the surface of the zinc oxide resistor may require some sort of insulating sheath such as a thin ceramic or glass coating to prevent the inhibition of element burn-back at low currents due to localized clamping by the non-linear resistor.

From the foregoing, it can be readily seen that there is provided by this invention a novel fuse construction incorporating the characteristics of a non-linear resistor that applies a predetermined threshold and an optimized shape to the arc voltage generated by the current limiting fuse.

Although there has been illustrated and described specific structures, it is to be clearly understood that the same were merely for purposes of illustration and that changes and modifications may be readily made therein by those skilled in the art without departing from the scope of this invention.

We claim:

1. A fuse, comprising:

(a) an insulating fuse housing;

(b) electrically conductive terminal means disposed at both ends of said fuse housing for sealing the ends thereof;

(c) an insulated non-linear resistor means comprised of a formulation of zinc oxide and electrically connected between the electrically conductive terminal means within said insulating fuse housing for limiting and shaping the arc voltage developed during current interruption; and (d) a fuse element electrically connected between the electrically conductive terminal means and in parallel with and spirally around the non-linear resistor means within the insulating fuse housing.

2. A fuse as recited in claim 1 wherein the insulating fuse housing is filled with a silica sand.

* * * * *